US006592332B1

(12) United States Patent
Stoker

(10) Patent No.: US 6,592,332 B1
(45) Date of Patent: Jul. 15, 2003

(54) PUMP-OFF CONTROL INTERRUPTER

(76) Inventor: Joe Kent Stoker, 1015 N. Liveoak, Breckenridge, TX (US) 76424

( * ) Notice: Subject to any disclaimer, the term of this patent is extended or adjusted under 35 U.S.C. 154(b) by 0 days.

(21) Appl. No.: 10/047,267

(22) Filed: Jan. 14, 2002

(51) Int. Cl.[7] ..... F04B 49/06
(52) U.S. Cl. ..... 417/12; 417/44.1
(58) Field of Search ..... 417/12, 43, 44.1, 417/44.11, 1

(56) References Cited

U.S. PATENT DOCUMENTS 3,269,320 A * 8/1966 Tilley et al. ..... 417/12
3,363,573 A * 1/1968 Jaeger ..... 417/12
3,705,532 A 12/1972 Hubby
3,838,597 A * 10/1974 Montgomery et al. ..... 417/1
3,851,995 A * 12/1974 Mills ..... 417/12
3,998,568 A 12/1976 Hynd
4,171,185 A * 10/1979 Duke et al. ..... 417/12
4,302,157 A 11/1981 Welton et al.
4,859,151 A * 8/1989 Reed ..... 417/12
4,873,635 A 10/1989 Mills
5,230,607 A * 7/1993 Mann ..... 417/44.1
5,284,422 A * 2/1994 Turner et al. ..... 417/44.11
5,314,016 A 5/1994 Dunham
5,362,206 A * 11/1994 Westerman et al. ..... 417/12
5,458,466 A 10/1995 Mills
5,823,262 A 10/1998 Dutton

* cited by examiner

*Primary Examiner*—Michael Koczo
(74) *Attorney, Agent, or Firm*—Milburn & Peterson, P.C.; Robert C. Peterson

(57) ABSTRACT

A pump-off control system for use with an electric motor driven pump jack assembly for operation of a down hole pump in which a circuit interrupter device is attached to the top of the polished rod of the pump jack and upon occurrence of fluid pound, the polished rod imparts sufficient force on the circuit interrupter device to open the electrical contacts of the device momentarily interrupting power to the electric motor shutting down the pump for a period of time determined by a time delay relay that controls the shut down time for the well.

10 Claims, 2 Drawing Sheets

PUMP-OFF CONTROL INTERRUPTER

BACKGROUND OF THE INVENTION

1. Field

The device for pump-off control pertains to control systems for pumping units generally referred to as sucker rod pumps. More particularly the pump-off control interrupter for the pump jack that interrupts the production cycle for a pre-determined time.

2. State of the Art

In the production of oil from the sub-service reservoir, frequently beam type pumping units are common artificial lift devices for producing oil. These, so called, sucker rod pumps reciprocate a down-hole pump mechanism that lifts oil on each upward stroke of the sucker rods and on the down stroke, oil flows into the pump and the process is repeated. Often in producing fluid by artificial means with sucker rod pumps, the oil flowing reservoir surrounding the well does not flow to the pump as fast as the pump can lift the oil and when this happens, the fluid level in the reservoir falls below the top of the pump plunger. A limited amount of oil, if any, flows into the barrel of the pump. At this point, the amount of oil being pumped is decreased and on the down stroke the pump plunger impacts the fluid with a hammer type pounding effect joining the sucker rods. Over long periods of time, this pounding causes fatigue and failure of the sucker rod pumping mechanism.

Various techniques have been developed to control the operation of the sucker rod pumps to minimize the fluid pound effect by disrupting the pumping operation for a sufficient period of time to permit oil from the reservoir to again increase the volume surrounding the well bore so that the plunger of the pump is below the fluid level and permits fluid pumping again.

U.S. Pat. No. 5,823,262 issued to Dutton discusses in some detail the problem in detecting the pump-off condition and providing adequate means to minimize the problem. Dutton proposes a flow meter arrangement for determining the volume of fluid being pumped and the pumping is shut down when measurement from the flow meter indicates a decline in pump efficiency, which indicates that the production fluid level in the tubing has fallen below the upper most travel of the plunger.

Another attempt to provide a pump-off control device utilizes the measurement of the length of time required for the pump to down stroke with a full barrel of oil and the time interval for the down stroke with less than a full barrel of oil. By these two measurements, pump-off is determined and the well shut down to prevent excessive fluid pound. The pump is allowed to pump a pre-determined number of cycles and if fluid pound is reached again, the time is reset on the new information.

Another system for pump-off control utilizes wave-form signals proportional to the load on the motor drawing the pump to determine the change in load wave-form when the pump is at pump-off.

SUMMARY OF THE INVENTION

The present invention provides a pump-off control system for sucker rod or beam pumping units, in which the pump motor is shut-off when the sucker rod unit undergoes fluid pound, which jolts the sucker rods. This action interrupts the electrical circuit supplying power to the pump motor. To accomplish this, Applicant mounts the pump-off interrupter on top of the polished rod on the balance beam pumping unit. The interrupter has a fixed electrical contact that moves with the movement of the polished rod and a floating electrical contact that rests on the fixed contact. When fluid pound occurs, there is sufficient jolt to the polished rod to cause the fixed and floating contacts of the interrupter to part, thus interrupting an electric circuit, which holds a normally open contact of a time delay relay closed as long as voltage is applied across the relay. In this fashion, when the relay opens by interruption of the electric circuit, power to the motor is interrupted until the electrical circuit is completed through the time delay relay. The time delay may be set to retain the well shut in for a sufficient amount of time to permit the fluid in the well bore of the reservoir to rise above the plunger to again efficiently pump oil from the reservoir.

It is therefore an object of the invention to provide a circuit interrupter attached to the polished rod, which opens a relay when the polished rod undergoes fluid pound shutting down the sucker rod pump.

It is another object of the invention to provide a pump-off interrupter mounted on the polished rod, which includes an insulated cylinder with one end attached to a metallic cylinder filled with Babbitt metal with a metallic disc attached to the Babbitt metal to provide one side of an electrical contact. The metallic cylinder is secured to the polished rod. A second metallic cylinder, with Babbitt metal to provide sufficient weight, secures a metallic disc to form the other side of an electrical contact, such that the contact is maintained during normal pumping operation of the balance beam pump and upon incurring fluid pound, the two contacts will separate from the impact shutting down the pump.

It is an additional object of the invention to provide a pump-off control mounted on the polished rod, which includes a plastic cylinder with one end securely attached by metallic material to the polished rod to provide one side of an electrical contact within the plastic cylinder. A metallic cylinder with metallic material secured in one end to form the other side of an electrical contact, including a series of removeable metal disc to provide sufficient weight to maintain the contact closed during normal operation and responding to fluid pound to break the electrical connection.

DESCRIPTION OF THE PREFERRED EMBODIMENT(S)

Figures 1, 1A:
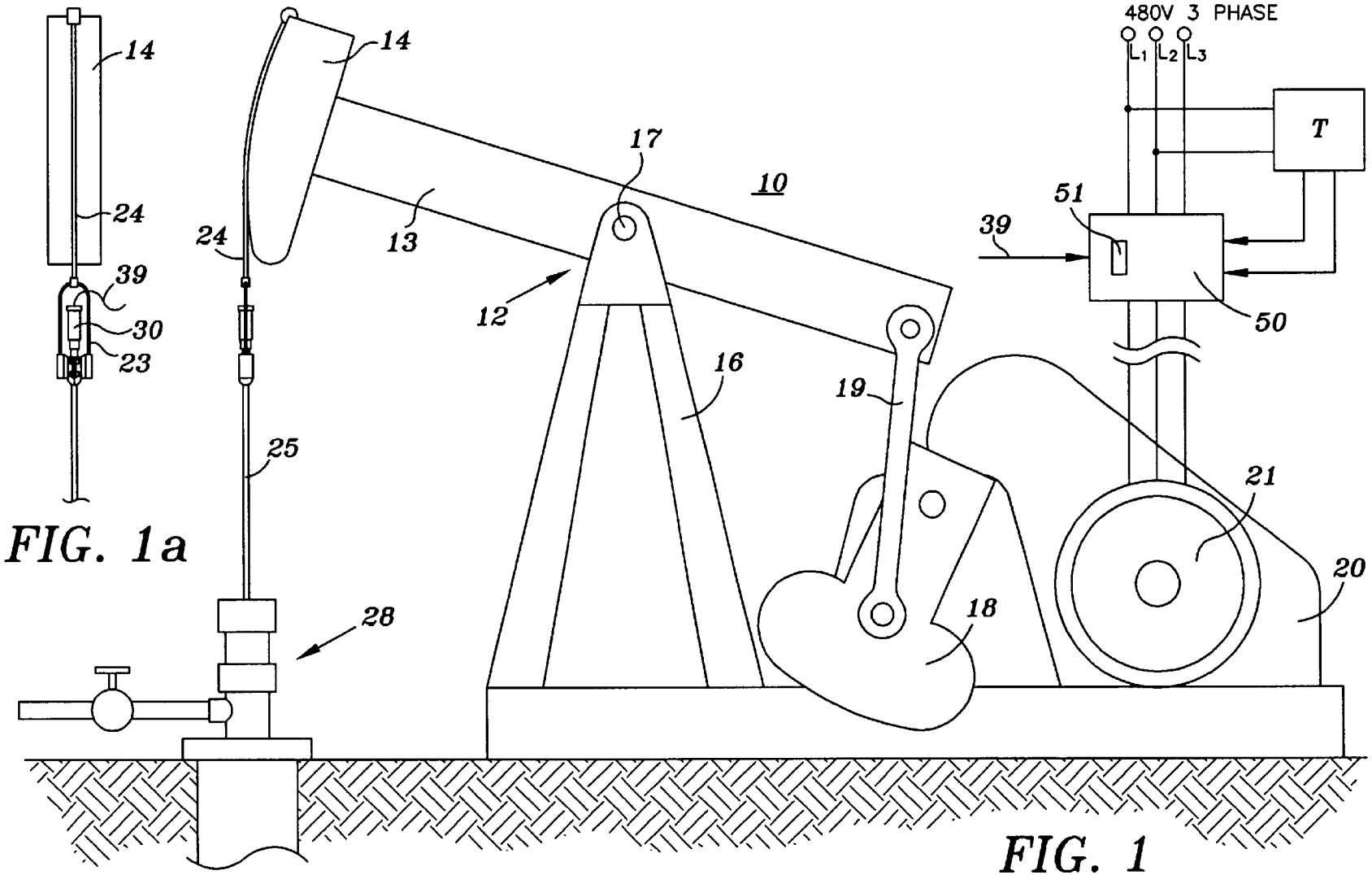
FIG. 1 is a schematic illustration of a walking beam, sucker rod pump system.
FIG. 1*a* illustrates the positioning of the pump-off control attachment to the polished rod of the pump system in FIG. 1.

Referring now to FIGS. 1 and 1*a*, a pump control system 10 consisting of a walking beam type pump jack 12, having a typical walking beam 13 with a horse head 14 and the walking beam 13 mounted on an A-frame 16 at pivot 17. Counter weight crank 18, driven through gear box 20 by electrical motor 21, is attached to the rear of walking beam 13 by a pair of pitman arms 19. Wire-line hangar 23 attached to horse head 14 by cable 24 is secured to polished rod 25. Polished rod 25 is connected to sucker rods extending from the reservoir to wellhead 28 in the production tubing (not shown).

Figure 2:
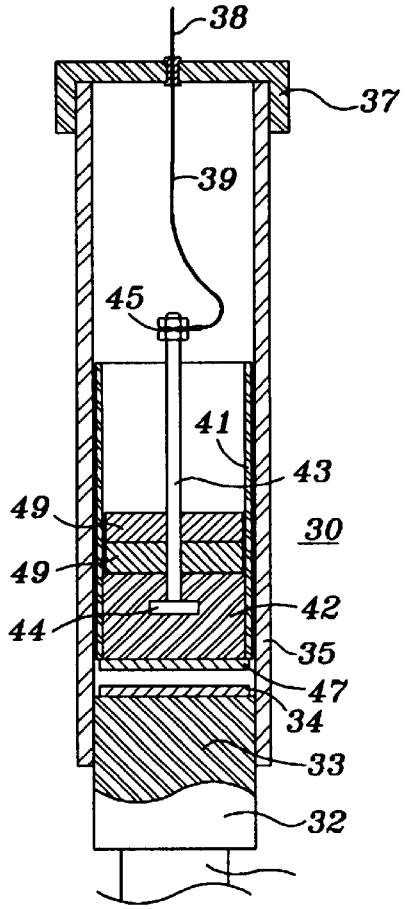
FIG. 2 illustrates the pump-off control separation of the contacts on impact.
Figure 3:
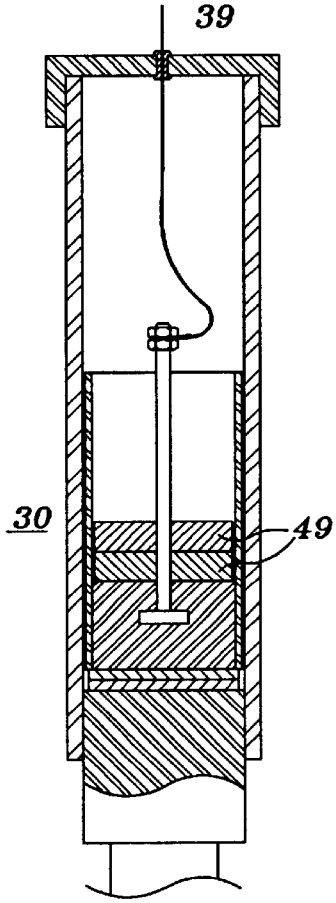
FIG. 3 illustrates the pump-off control in the normally closed position.

The pump-off control device (sometimes referred to as POC) 30 as best seen in FIGS. 2 and 3 consists of a rod box 32 threaded onto polished rod 25 and includes a quantity of Babbitt material 33 to provide some weight to rod box 32. On top of the Babbitt material is metallic disc 34 secured by the Babbitt material to rod box 32. Cylindrical sleeve 35 is secured to cylindrical rod box 32. Cylindrical sleeve 35, made of insulating material, has a plastic cap 37. The cap is threadably secured to cylindrical sleeve 35 and has a grommet 38 to sealably engage wire 39, which extends through the grommet and is connected to control box 50. A second cylindrical rod box 41 contains Babbitt material 42, which secures bolt 43 with head 44 buried in Babbitt material 42. Bolt 43 has a pair of nuts 45, which secure wire 39. Metallic contact or disc 47 is secured to Babbitt material 42 facing metallic disc 34. Metallic contact or disc 47 and metallic contact or disc 34 provide smooth contact surfaces for rod box 41 and rod box 32, respectively, to provide good electrical contact therebetween. Rod box 41 is of a lesser outer diameter than the inner diameter of cylindrical sleeve 35 and is free to slide up and down in cylindrical sleeve 35. For purposes of adjusting the weight of rod box 41, metallic weights 49, may be inserted in rod box 41 surrounding bolt 43. The weight adjustment may be readily done in the field by removing plastic cap 37, sliding rod box 41 out of the top, far enough to remove nuts 45 from bolt 43 and inserting one or more metallic weights 49 inside rod box 41 and reassemble with nuts 45 re-attached to bolts 43 securing wire 39 to bolt 43. Likewise, if metallic weights 49 initially in rod box 41 are too heavy for operations, they may be removed in the field in the reverse manner as if they were being added.

Transformer T is attached to line L1 and line L2 of power source S, providing 480 volt 3-phase power for operation of motor 21. Transformer T provides 110 volt power to control box 50. Control box 50 houses auto switch 51, motor controller 52, dual normally opened relay F2 and normally opened delay relay F1. Pump-off control 30 completes the electrical circuit through contacts 34 and 47 and wire 39 to the coil of time delay relay F1 providing power to maintain the contacts of normally open delay relay F1 closed. Optionally, timer F4 may be provided in control box 50 or externally to provide a read out of the cycles and/or cumulative time pump jack 12 operated to pump oil.

Figure 4:
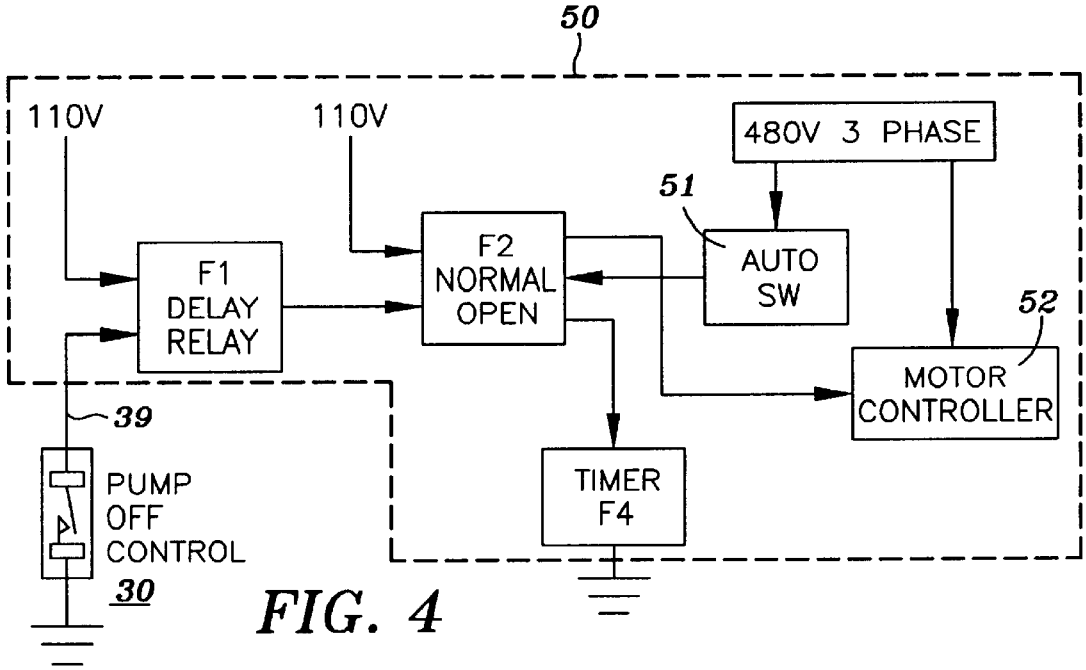
FIG. 4 is a schematic diagram of the motor control circuit of the pump-off control.

Referring to FIG. 4, the operation of the pump-off control system is best described beginning with pump jack 12 operating in the normal manner without fluid pound occurring. At this time rod box 41 remains with metallic disc 47 firmly seated on metallic disc 34. Upon fluid pound occurring, rod box 32 transmits the impact of fluid pound through metallic disc 34 to metallic disc 47, secured to rod box 41, which is free to move in cylindrical sleeve 35. The impact causes separation of metallic disc 47 from metallic disc 34, thereby interrupting the electrical circuit supplying power to the coil of delay relay F1, which holds the contacts of delay relay F1 closed during normal operation of pump jack 12. With this momentary interruption, the contacts of relay F1 open. Since the contacts of normally open relay F2 are maintained closed, as long as the contacts of delay relay F1 are closed, upon the opening of the contacts of delay relay F1 by the momentary separation of metallic disc 47 and metallic disc 34, the contacts of relay F2 open and opens the circuit from auto switch 51 to motor controller 52 interrupting the power to motor controller 52 and shuts down motor 21 and also stops timer F4. After the momentary interruption of power to delay relay F1 caused by the separation of metallic disc 47 from metallic disc 34, normally open delay relay F1 begins counting the delay before being energized at which time the contacts of delay relay F1 will close restoring ground to normally open relay F2. This time delay may be of any appropriate length from several minutes to sixteen hours or more. Once normally open relay F2 is grounded, it becomes energized and the contacts of relay F2 close completing the circuit to provide power from power source S through auto switch 51, relay F2 to motor controller 52 and at the same time provides power to timer F4, at which time motor controller 52 starts pump motor 21, at the same time timer F4 begins to count. Pump motor 21 and consequently pump jack 12 operate until fluid pound is once again encountered, at which time delay relay F1 opens due to loss of power, which causes normally open relay F2 to open shutting off the power to motor controller 52 and timer F4. The operations of motor controller 52 and timer F4 recommence when the time delay of delay relay F1 expires and relay F1 becomes energized and the contacts of delay relay F1 dose completing the electrical circuit through the coil of normally open relay F2, which in turn is energized and closes the contacts restoring power to motor controller 52 and timer F4.

A typical pump-off control of the invention as show in FIGS. 2 and 3 would include cylindrical sleeve 35 of polyvinyl chloride (PVC), 8 inches long and have a 1½ inch O.D. with cap 37 being made of the same material. Rod box 32 would have a 1⅝ inch O.D. and would be filled to depth of 1 inch with Babbitt material and washer 34 would have a 1 7/16 inch O.D. Rod box 41 would have a 1½ inch O.D. and would be 4 inches long. Rod box 41 would include a 1¾ inch depth of Babbitt fill and would secure a 2½ inch bolt with ⅜ inch diameter extending vertically in rod box 41. Washer 47 with a 1 7/16 inch O.D. would be secured to the bottom of Babbitt material 42 of rod box 41. Bolt 43 would have two nuts 45 to secure wire 39. Disc 49 would have a 1¼ inch diameter and ½ inch thick with a 5/16 inch center hole to fit over bolt 43.

Suitable relays for use as normally open delay relay F1 and normally open relay F2 may be obtained from Dayton Electric Mfg. Co., Niles, Ill. Motor controller may be obtained from Cutler Hammer suppliers. The time may be obtained through regular commercial suppliers of motors and timing devices, such as Cramer Company, Old Saybrook, Conn.

It should be understood that various other arrangements of the control circuit are possible with the pump-off control system of the present invention to shut-in the well upon occurrence of fluid pound affecting the pump-off control and interrupting the continuity of the control circuit.

What is claimed:

1. A pump-off control system for use in conjunction with an electric motor driven beam pumping unit including a polished rod attached by a wire-line carrier and hangar assembly to a horse head of the beam and to a down hole sucker rod pump comprising:

(a) an electrical power source;

(b) an interlocking pair of normally open relays wherein the first relay of said pair must be dosed before the second relay of said pair can close;

(c) a first electrical circuit connected to the power source for energizing the first relay after a pre-determined time delay;

(d) a control device attached to the polished rod as a component of said first electrical circuit, the control device momentarily de-energizing the first relay upon incurring fluid pound;

(e) a second electrical circuit connected to the power source for energizing the second relay when the first relay is energized; and (f) a motor controller connected to the power source for starting and stopping the electric motor, the motor controller starting the electric motor in response to the second relay being energized and stopping the electric motor in response to the second relay being de-energized.

2. The control device of claim 1 comprising:

(a) an insulating sleeve member closed at one end by a removable insulating cap;

(b) a metallic member secured in the other end of the sleeve member and attached to the polished rod for movement with the polished rod;

(c) a metallic cylinder slideably retained within the insulating sleeve member having a metal plug at one end, said metal plug normally abutting said metallic member and making electrical contact therewith interruptible upon encountering fluid pound force; and (d) an electrical conductor connected to the metal plug and extending through the cap.

3. The control device of claim 2 wherein the metal plug is Babbitt material.

4. The control device of claim 2 wherein the insulating sleeve member is plastic.

5. A pump-off control system for use in conjunction with an electric motor driven beam pumping unit including a polished rod attached by a wire-line carrier and hangar assembly to a horse head of the beam and a down hole sucker rod pump comprising:

(a) an electrical power source;

(b) an electrical power circuit coupling the power source to the electric motor for supplying power to the electric motor; and (c) an electric motor control circuit for connecting and disconnecting the power circuit to the electric motor including a mechanical interrupter secured to the polished rod maintaining the power circuit coupled to the electric motor until the polished rod encounters fluid pound, causing the mechanical interrupter to disconnect the power source from the electric motor for a preset time delay period.

6. A pump-off control system for use in conjunction with an electric motor driven beam pumping unit including a polished rod attached by a wire-line carrier and hangar assembly to a horse head of the beam and to a down hole sucker rod pump comprising:

(a) an electrical power source;

(b) a first electrical circuit connected to the power source for energizing a first relay after a pre-determined time delay;

(c) a control device attached to the polished rod as a component of said first electrical circuit, the control device momentarily de-energizing the first relay upon incurring fluid pound, (d) a second electrical circuit connected to the power source for energizing a second relay only while the first relay is energized; and (e) a motor controller connected to the power source for starting and stopping the electric motor, the motor controller starting the electric motor in response to the second relay being energized and stopping the electric motor in response to the second relay being de-energized.

7. The control device of claim 6 comprising:

(a) plastic sleeve;

(b) a metal plug secured in one end of plastic sleeve and the other end of the metal plug secured to the polished rod;

(c) a metal member slideably retained in the plastic sleeve resting upon the metal plug; and (d) the metal member and the metal plug forming an electrical contact interruptible upon occurrence of fluid pound.

8. The control device of claim 7 wherein the metal plug includes Babbitt metal.

9. The control device of claim 7 wherein the metal member includes at least one stackable weight.

10. The control device of claim 7 wherein the plastic sleeve is polyvinyl chloride.

* * * * *